US005710105A

United States Patent [19]

Shen

[11] Patent Number: 5,710,105

[45] Date of Patent: Jan. 20, 1998

[54] $TM_{0i0}$ MODE HIGH POWER HIGH TEMPERATURE SUPERCONDUCTING FILTERS

[75] Inventor: Zhi-Yuan Shen, Wilmington, Del.

[73] Assignee: E. I. Du Pont de Nemours and Company, Wilmington, Del.

[21] Appl. No.: 439,402

[22] Filed: May 11, 1995

[51] Int. Cl.[6] ..... H01P 7/10; H01B 12/02

[52] U.S. Cl. ..... 505/210; 505/700; 505/701; 505/866; 333/99 S; 333/219; 333/204

[58] Field of Search ..... 333/99 S, 204, 333/205, 219; 505/210, 700, 701, 866

[56] References Cited

U.S. PATENT DOCUMENTS

| | | | |
|---|---|---|---|
| 4,238,747 | 12/1980 | Harp et al. | 333/228 |
| 4,727,342 | 2/1988 | Ishikawa et al. | 333/204 X |
| 5,172,084 | 12/1992 | Fiedziuszko et al. | 333/204 |
| 5,281,934 | 1/1994 | Shiau et al. | 333/134 |

FOREIGN PATENT DOCUMENTS

| | | | |
|---|---|---|---|
| 305702 | 12/1989 | Japan | 333/204 |

OTHER PUBLICATIONS

Curtis, J.A. et al, *IEEE MTT-S International Microwave Symposium Digest*, vol. II, 443–446 (1991).

Itozaki, H. et al, *Proceedings: Microwave Workshops and Exhibition*, Tokyo Japan, pp. 1–5 (1991).

Zhi-Yuan Shen et al., High Power HTS Filters with Novel Backside Coupling, *IEEE Transactions on Microwave Theory and Techniques*, vol. 44, No. 6, 984–986, Jun. 10, 1996.

A. M. Khilla, Ring and Disk Resonator CAD Model, *Microwave Journal*, vol. 27, No. 11, 91–105, Nov. 1984.

A. K. Sharma, Spectral Domain Analysis of a Hexagonal Microstrip Resonator, *IEEE Transactions on Microwave Theory and Techniques*, vol. 30, No. 5, 825–828, May 1982.

*Primary Examiner*—Benny T. Lee

[57] ABSTRACT

High power high temperature superconductor filters having $TM_{0i0}$ mode (i=1, 2, 3, . . . ) circular shaped high temperature superconductor planar resonators or symmetrical polygon shaped resonators which eliminates wrap-around H-field and very sharp current peaks at the edge of the resonator are provided.

6 Claims, 9 Drawing Sheets

$TM_{0i0}$ MODE HIGH POWER HIGH TEMPERATURE SUPERCONDUCTING FILTERS

FIELD OF THE INVENTION

This invention relates to planar high temperature superconducting filters, specifically such devices capable of handling very high power levels operated at the $TM_{0i0}$ (i=1, 2, 3, . . . ) mode to avoid current density peaks.

BACKGROUND OF THE INVENTION

A filter is a frequency selecting device, which allows radiofrequency signals within its passing band to pass through and rejects the radiofrequency signals outside its passing band. Filter banks and multiplexers consist of a series of filters in parallel, each having different passing bands to divide or combine radiofrequency signals having different frequencies. Filters are the basic components of filter banks and multiplexers. Filters, filter banks and multiplexers are widely used in electronic systems for selecting and channeling radiofrequency signals. The basic electrical performance requirements of a filter are: defined bandwidth, low in-band insertion loss, high off-band rejection, and sharp skirts. Conventional filters made of normal metals such as copper or gold have difficulties in meeting these requirements due to their high surface radiofrequency resistance. Filters made using a high temperature superconductor have extremely low surface radiofrequency resistance, and can easily meet these requirements. However, high temperature superconductor materials have limited power handling capability due to their limited critical current density, $J_c$. The maximum current density, $J_{max}$, in high temperature superconductor filters must be below $J_c$ ($J_{max}<J_c$), which limits the power handling capability. For applications such as in electronic systems transmitters, the high temperature superconductor filters must be able to handle high power levels ranging from watts to kilowatts. This is a daunting challenge for high temperature superconductor filter designers.

A conventional planar high temperature superconductor filter, such as described in J. A. Curtis and S. J. Fiedziuszko, "Miniature dual mode microstrip filters," 1991 *IEEE MTT-S International Microwave Symposium Digest*, Vol. 2, pp. 443—446, June, 1991, and shown in FIGS. 1(*a*) and 1(*b*) consists of a series of high temperature superconductor resonators 3 in a two dimensional planar pattern deposited on one side of a substrate 1 with the other side of the substrate coated with high temperature superconductor film as a ground plane 2 (see FIG. 1*b*). Such planar high temperature superconductor filters are compact, which renders them suitable for making filter banks or multiplexers.

The square high temperature superconductor resonator of FIG. 1(*a*) and FIG. 1(*b*) is operating at $TM_{10}$ mode (herein the first and the second subscripts represent the mode indexes along the x-direction and the y-direction, respectively as depicted in FIG. 1*a*) with the radiofrequency current distribution described by equation (1) as follows:

$$J_x(x,y)=J_x(x)\cdot J_x(y) \quad (1)$$

The subscript x for $J_x$ means that the current of the $TM_{10}$ mode in the square resonator flows only along the x direction as shown in FIG. 1(*a*). The current distribution $J_x(x)$ as a function of x and $J_x(y)$ as of a function of y are also shown in FIG. 1(*a*). $J_x(x)$ has a peak at x=a/2. $J_x(y)$ has two peaks at y=0 and y=a. The length of the square edge is defined as a. According to equation (1), the overall current peak is located at (x=a/2, y=0) and (x=a/2, y=a) as depicted in FIG. 1(*a*) by the longest of the white arrows 4. The $J_x(x)$ distribution is due to the standing wave in the resonator, and in this particular case $J_x(x)$ is a sinusoidal function having a ratio R of peak value to average value of R=1.57. On the other hand, the $J_x(y)$ distribution is due to the concentrated magnetic field (H-field) wrap-around at the edges of the high temperature superconductor resonator 3 as shown by arrows 5 in the cross sectional view of FIG. 1(*b*). The $J_x(y)$ function has very sharp peaks, therefore, the ratio R of the peak value to the average value is very large (R is much greater than 10). The power handling capability is restricted by the maximum current density value, $J_{max}$, determined by the current peaks which must be below the $J_c$ (critical current density) of the high temperature superconductor material. The power handling capability is increased by reducing the maximum current density, $J_{max}$, i.e. by reducing the ratio R. Since the sinusoidal distribution of $J_x(x)$ has only a small R, and $J_x(x)$ distribution is intrinsic due to the standing wave nature of the resonance, attention is naturally focused at the $J_x(y)$ distribution which has a very large R value which is not intrinsic. The large peaks at the edges of the high temperature superconductor resonator are due to the fact that the H-field wraps around at the edges as shown in FIG. 1(*b*). If at some selected mode, the H-field wrap-around could be eliminated, power handling capability,could be increased.

The power handling capability is determined by two factors: (1) the resonators and (2) the coupling circuits. The power handling capability of the coupling circuits can be improved by back-side coupling circuits described in copending commonly assigned patent application Ser. No. 08/438,827, filed May 11, 1995.

The present invention improves the power handling capability of the planar high temperature superconductor resonators by utilizing round or symmetrical polygon shaped $TM_{0i0}$ mode (i=1, 2, 3, . . . ) high temperature superconductor resonators as the basic building blocks for high temperature superconductor filters, filter banks and multiplexers.

SUMMARY OF THE INVENTION

The present invention provides an improved high temperature superconducting filter of the type having (a) at least two resonators, each comprising a patterned high temperature superconductor film deposited on one side of a substrate;

(b) a ground plane comprising a high temperature superconductor film deposited on a side of the substrate opposite the resonators; and (c) a coupling circuit, wherein the improvement comprises substantial confinement of the magnetic field between the patterned high temperature superconductor film and the ground plane at an operating mode of $TM_{0i0}$ wherein i is an integer of at least 1. Preferably the resonators are in the shape of a circle or a symmetrical polygon. Use of any conventional coupling circuit is appropriate.

BRIEF DESCRIPTION OF THE DRAWINGS

FIG. 1(*a*) shows the front view, in which the radiofrequency current distribution (arrows) is depicted. The distribution along the x and y directions is also shown. FIG. 1(*b*) shows a cross sectional view of the resonator, in which the radiofrequency magnetic field distribution (arrows) is depicted.

FIG. 2(*a*) shows the front view, in which the radiofrequency current distribution (arrows) and the radiofrequency magnetic field distribution (dashed circles) are depicted. FIG. 2(*b*) shows a cross sectional view of the resonator, in which the radiofrequency magnetic field distribution (arrows) is shown.

FIG. 4(*a*), FIG. 4(*b*), and FIG. 4(*c*) show the front view, the back view, and the cross sectional view of the filter circuit, respectively.

FIG. 5(*a*), FIG. 5(*b*), and FIG. 5(*c*) show the front view, the back view, and the cross sectional view of the filter circuit, respectively.

FIG. 6(*a*), FIG. 6(*b*), and FIG. 6(*c*) show the front view, the back view, and the cross sectional view of the filter circuit, respectively.

FIG. 7(*a*), FIG. 7(*b*), and FIG. 7(*c*) show the front view, the back view, and the cross sectional view of the filter circuit, respectively.

FIG. 8(*a*), FIG. 8(*b*), and FIG. 8(*c*) show the front view, the back view, and the cross sectional view of the filter circuit, respectively.

FIG. 9(*a*), FIG. 9(*b*), and FIG. 9(*c*) show the front view, the back view, and the cross sectional view of the filter circuit, respectively.

DETAILED DESCRIPTION OF THE INVENTION

The purpose of this invention is to build compact planar high temperature superconductor filters with very high power handling capability. Resonators are the main components of filters. The key to increasing the power handling capability of the planar high temperature superconductor filters is to increase the power handling capability of the planar high temperature superconductor resonator.

As used herein, the following terms have the stated definitions.

"Substantial" means greater than 90%, preferably greater than 95%, most preferably greater than 98%.

"Symmetrical polygon" means a polygon of at least six sides wherein all sides are of equal length and all angles are equal.

Figure 1B:
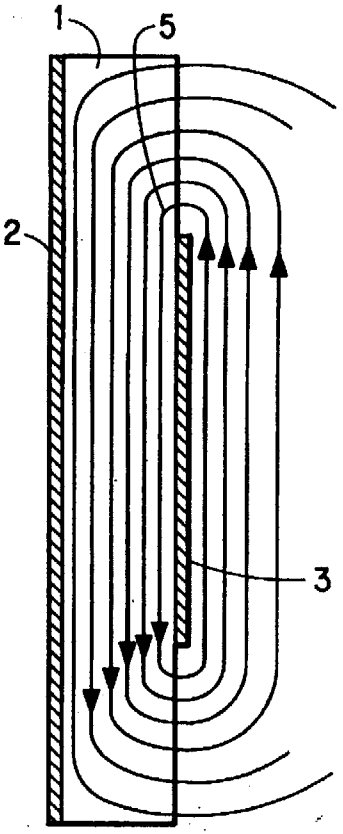
FIG. 1b (PRIOR ART)
FIG. 1 shows a prior art square high temperature superconductor resonator.
Figure 1A:
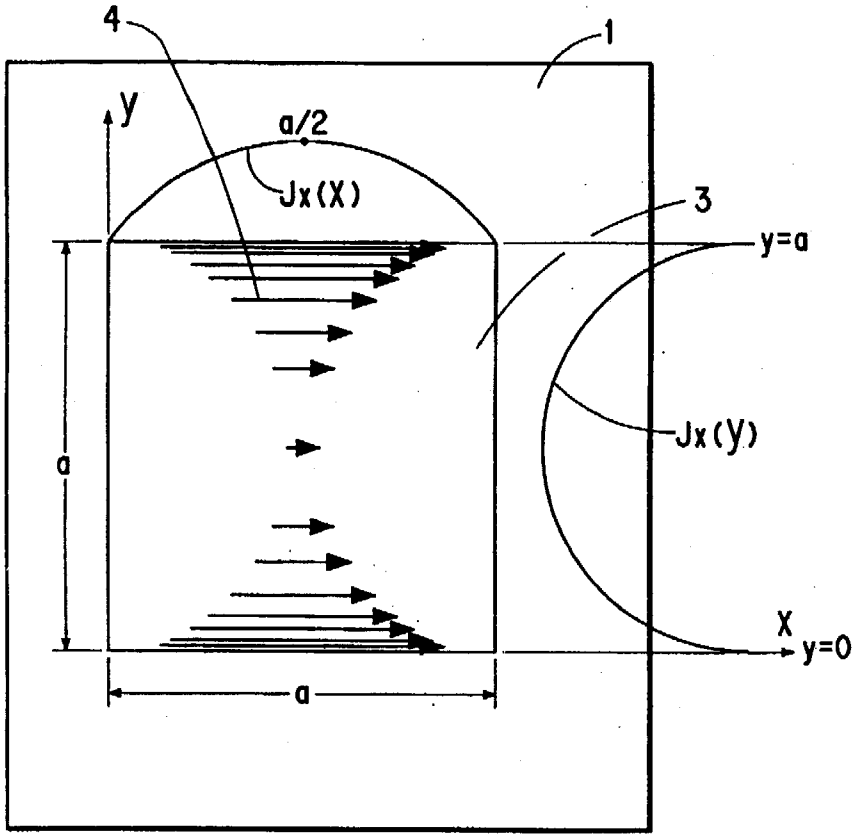
FIG. 1a (PRIOR ART)
Figure 2B:
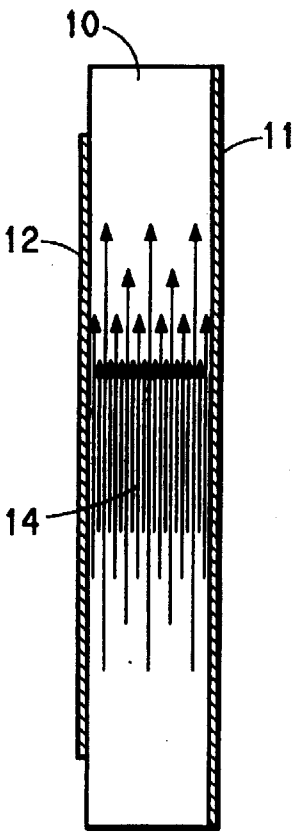
FIG. 2 shows the round high temperature superconductor resonator of the present invention operating at $TM_{010}$ mode, which is used as a basic building block for the high power filters of the present invention.
Figure 2A:
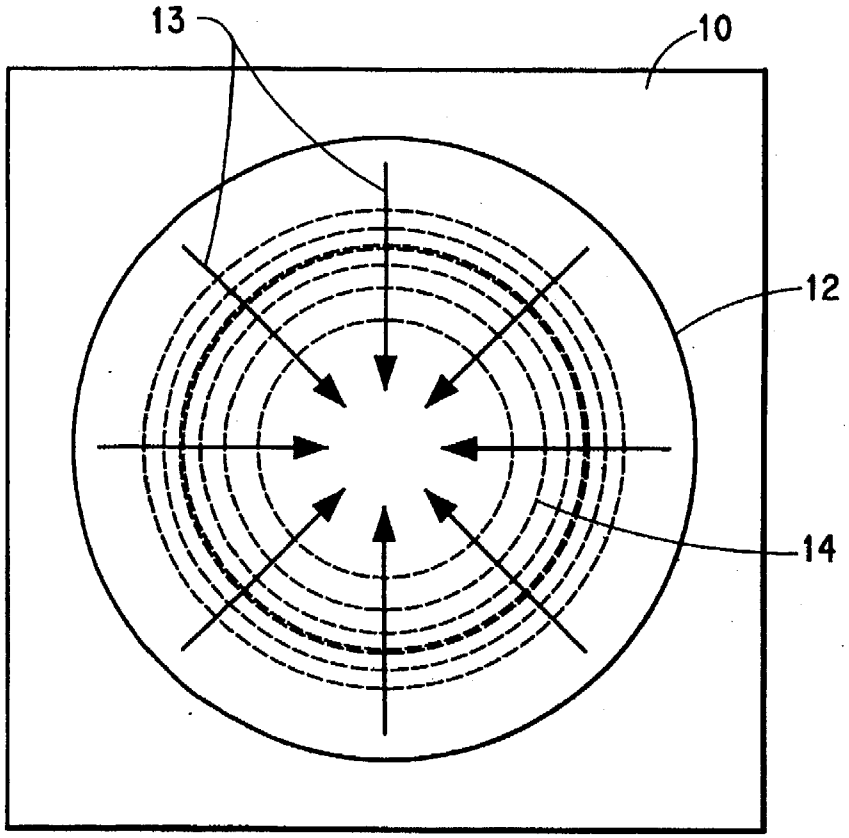

This invention provides for high power handling high temperature superconductor devices based on resonators which are circular or symmetrical polygon in shape. FIG. 2 shows a circular shaped $TM_{010}$ (i=1) mode high temperature superconductor resonator, which serves as one of the components of the high power high temperature superconductor filters of the present invention. The circular shaped high temperature superconductor resonator 12 is deposited on the front surface of a substrate 10 as shown in FIGS. 2(*a*) and 2(*b*). As shown in FIG. 2(*b*) the back side of substrate 10 is coated with high temperature superconductor thin film 11 serving as the ground plane of the resonator 12. The $TM_{010}$ mode current 13 is shown in FIG. 2(*a*) by the arrows. The H-field 14 (magnetic field distribution) is shown by the dashed circles in FIG. 2(*a*) and by the arrows in FIG. 2(*b*). FIG. 2(*b*) clearly shows that the H-field is confined between the high temperature superconductor resonator 12 and the high temperature superconductor ground plane 11. There is no wrap-around H-field at the edges of the resonator as shown in FIG. 1, and therefore the sharp current peaks are eliminated. This feature means that the $TM_{010}$ mode high temperature superconductor resonator can handle power which is orders of magnitude higher than the resonators of the prior art, such as the example shown in FIG. 1.

Figures 3A, 3B, 3C:
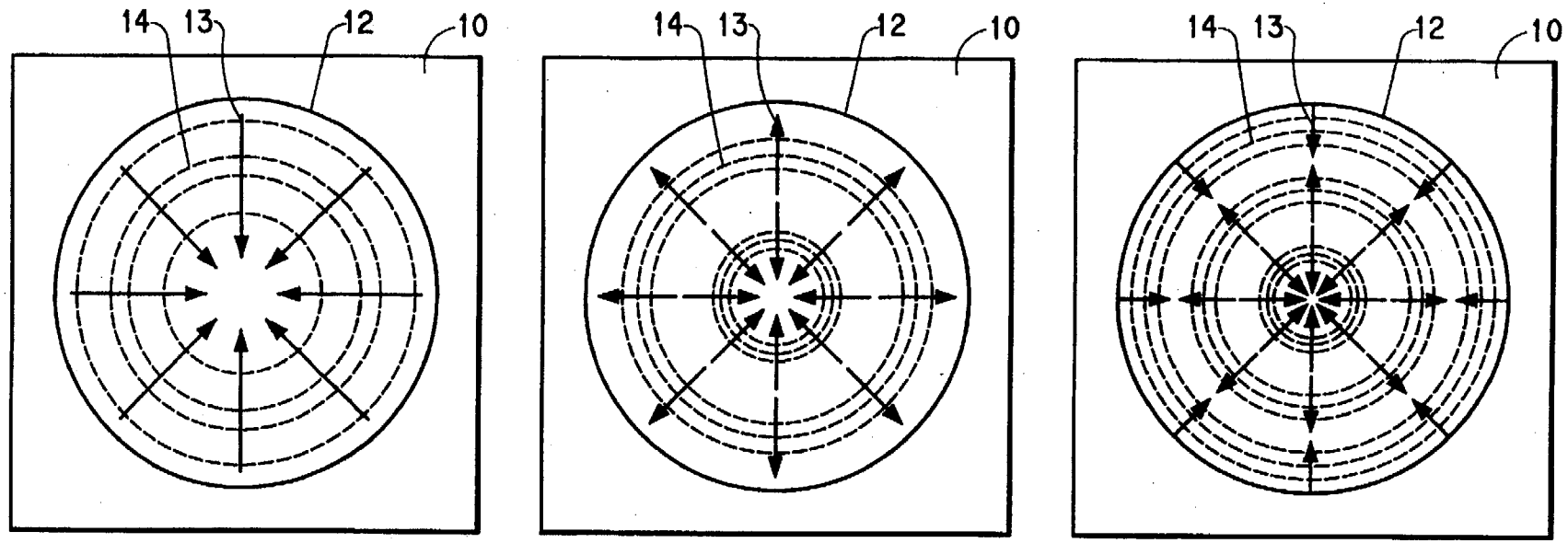
FIG. 3 shows the radiofrequency current (arrows) and radiofrequency magnetic field (dashed circles) distribution patterns and the current density function variation along the radial direction of three modes. Modes $TM_{010}$, $TM_{020}$, and $TM_{030}$, are shown in FIG. 3(*a*), FIG. 3(*b*), and FIG. 3(*c*), respectively. These modes can be used in the high power high temperature superconductor filters of the present invention.

The $TM_{010}$ mode is not the only one which provides high power handling capability and can be used in the present invention. In fact, in a circular shaped resonator, there is a series of modes having a circular H-field confined between the resonator and the ground plane and without the wrap-around H-field which causes sharp current peaks which are suitable for use in the present invention. These are $TM_{0i0}$ modes, wherein i is a positive integer of at least one and is the mode index along the radial direction. The first subscript of 0 represents the mode index in the azimuthal direction. The third subscript 0 represents the mode index in the axial direction perpendicular to the surface of the resonator. FIG. 3 shows three modes with i=1 for the $TM_{010}$ mode shown in FIG. 3(*a*), i=2 for the $TM_{020}$ mode shown in FIG. 3(*b*) , and i=3 for the $TM_{030}$ mode in FIG. 3(*c*) . In each of FIGS. 3(*a*), 3(*b*) and 3(*c*), reference numeral 10 is the substrate, reference numeral 12 is the resonator comprising a high temperature superconductor circular pattern, reference numeral 13 (white arrows) depicts the current distribution, and reference numeral 14 (dashed lines) depicts the H-field distribution. The distribution functions of current density $J_\rho$ and the H-field $H_\phi$ along the radial direction, ρ, for the $TM_{010}$, $TM_{020}$, and $TM_{030}$ modes are the Bessel functions, $J_1(\rho)$, $J_2(\rho)$, and $J_3(\rho)$, respectively, which are shown in the curves below the corresponding resonators in FIGS. 3(*a*), 3(*b*) and 3(*c*), respectively. All of these modes have the same previously described feature, i.e. the circular H-field is confined within the circle and there is no wrap-around H-field and no sharp current peaks at the edge. These modes and any other $TM_{0i0}$ mode (i=1, 2, 3, . . . ) can be used for making the high temperature superconductor filters handling very high power of the present invention.

The resonant frequencies of the $TM_{0i0}$ modes (i=1, 2, 3, . . . ) in a circular shaped resonator can be approximately calculated by using the following equation:

$$f_{0,i}=c\cdot r_i/[\pi D\,(\epsilon_{eff})^{1/2}] \quad (2.a)$$

$$J_1(r_i)=0,\ (i=1, 2, 3, \ldots) \quad (2.b)$$

wherein $f_{0,i}$ is the resonant frequency of the $TM_{0i0}$ mode, c is the speed of light in free space, D is the diameter of the circular resonator, and $\epsilon_{eff}$ is the effective dielectric constant, which is very close to the dielectric constant, $\epsilon_r$, of the substrate, such as the commonly used $LaAlO_3$ with $\epsilon_r$=24. $r_i$ is the ith root of the Bessel function $J_1(r_i)$ as shown in equation (2.b). The values of first four roots are: $r_1$=3.832; $r_2$=7.016; $r_3$=10.173; $r_4$=13.324.

According to equation (2*a*), for a given circular high temperature superconductor resonator with a fixed diameter, D, the resonant frequency, $f_{0,i}$, increases monotonically with increasing mode index, i. Put another way, for a given resonant frequency, $f_{0,i}$, the diameter, D, of the circular resonator increases monotonically with increasing mode index, i. Therefore, for low frequency compact filters, the lowest $TM_{0i0}$ mode, i.e. the $TM_{010}$ mode, is preferred due to its small size. For higher frequencies such as in the millimeter range, selecting a higher mode such as $TM_{020}$, or $TM_{030}$ has the advantage of avoiding small sized patterns and having strict manufacturing tolerances.

Note that the current and the H-field distributions of all $TM_{0i0}$ modes (i=1, 2, 3, . . . ) are azimuthally symmetrical as in the examples shown in FIG. 2 and FIG. 3. This is intrinsic due the first mode index being equal to zero. In order to maintain the azimuthal symmetrical fields of the $TM_{0i0}$ mode resonator, attention should be directed to the coupling circuits, i.e. the coupling fields should be uniformly spread along the circular edge of the high temperature superconductor resonators, as detailed hereinafter.

This invention also comprises a high temperature superconductor filter operating at $TM_{0i0}$ mode (i=1, 2, 3, . . . ) having a symmetrical polygon shaped resonator with the number of sides, n, being at least six, preferably greater than about eight. Symmetry means that all the side lengths are equal and all the angles in the polygon are equal. Such symmetrical polygonal high temperature superconductor resonators have features similar to the circular one previously described. The resonant frequencies of such $TM_{0i0}$ symmetrical polygon resonators can also be approximately calculated by using equations (2.a) and (2.b), where in this case, D is the distance between two opposite sides. The $TM_{0i0}$ mode (i=1, 2, 3, . . . ) symmetrical polygon shaped resonators also can be used as components of the high power high temperature superconductor filters, filter banks, and multiplexers of the present invention.

Figure 9A:
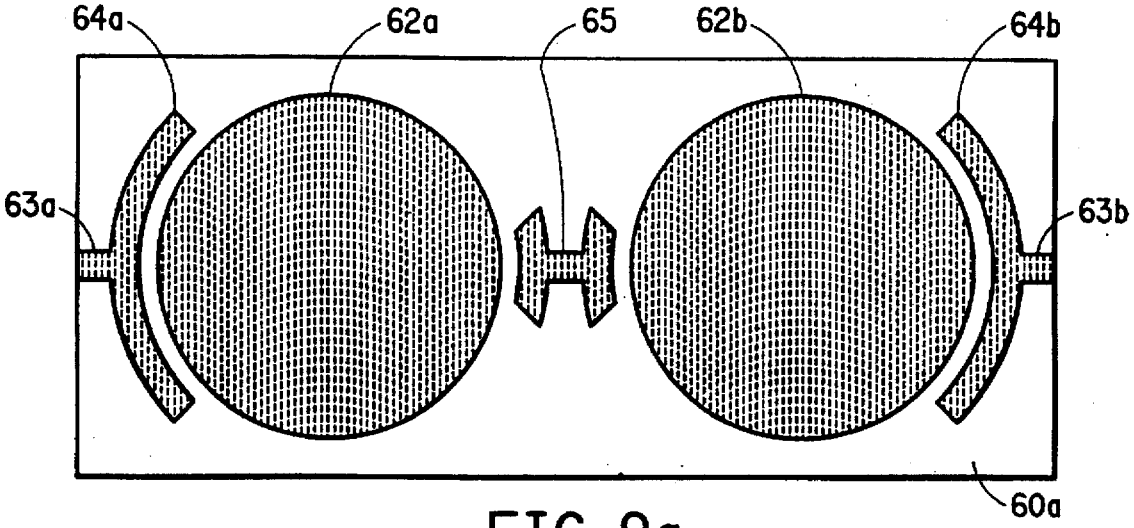
FIG. 9 shows a 2-pole circular shaped $TM_{010}$ mode high temperature superconductor filter of the present invention similar to that shown in FIG. 4, except that it is in the strip line form.
Figure 9B:
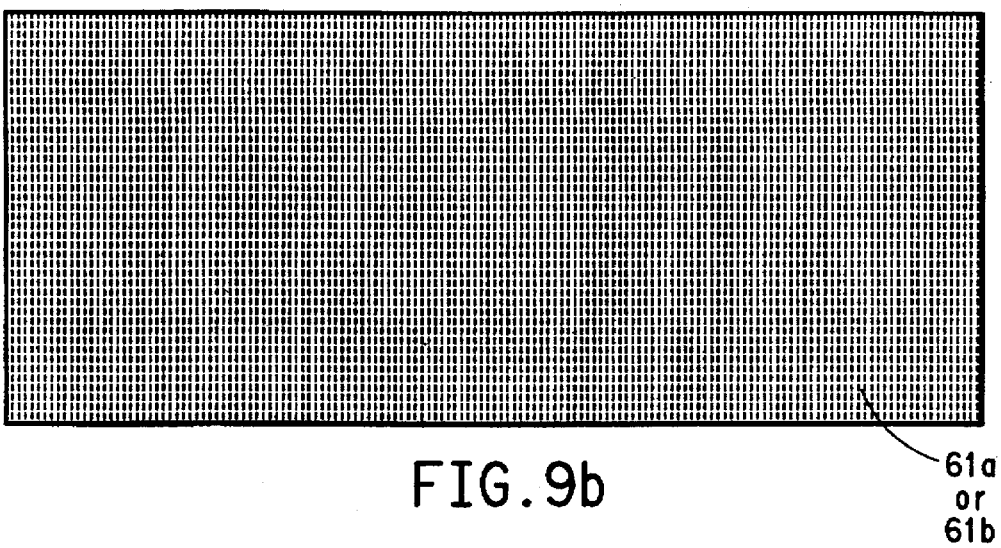
Figure 9C:
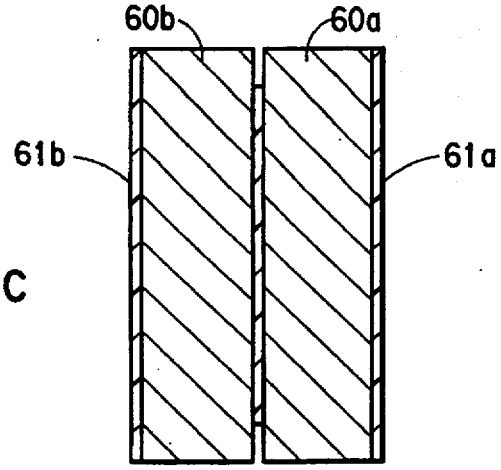

The inventive $TM_{0i0}$ mode (i=1, 2, 3, . . . ) resonators can be in the microstrip line form (i.e. signal-ground form) with one ground plane as shown in FIG. 2(*b*), and can also be in the strip line form (i.e. ground-signal-ground form) with two ground planes as shown in FIG. 9(*c*). Both the microstrip line form and the strip line form high temperature superconductor resonators can be used in the high power high temperature superconductor filters, filter banks, and multiplexers.

Figure 4A:
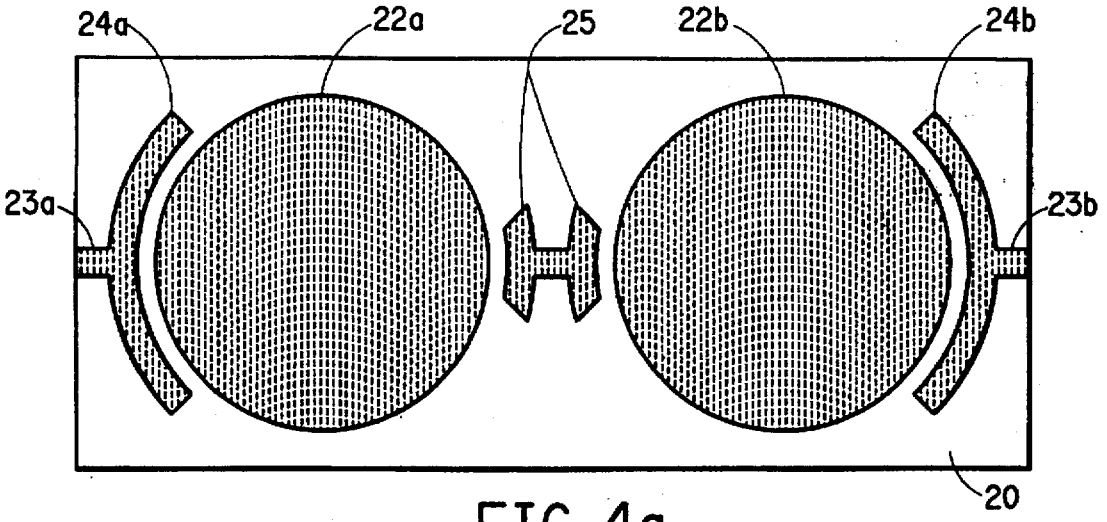
FIG. 4 shows an example of a 2-pole circular shaped $TM_{010}$ mode high temperature superconductor filter of the present invention in the microstrip line form with front-side coupling.
Figure 4B:
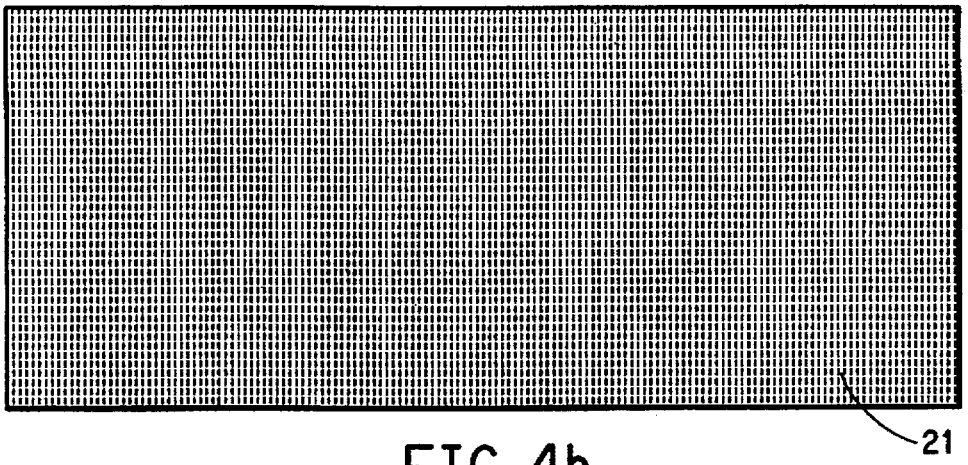
Figure 4C:
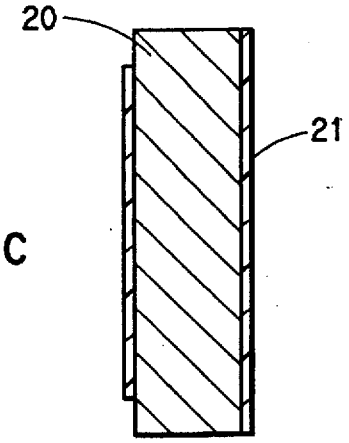

FIG. 4 shows an embodiment of the high power high temperature superconductor filter of the present invention in the microstrip line form. In this particular case, it is a 2-pole filter with 2 circular shaped high temperature superconductor resonators and coupling circuits deposited on the front side of the substrate. FIG. 4(*a*) shows the front view, in which 22*a*, 22*b* are the two $TM_{010}$ high temperature superconductor resonators deposited on substrate 20. The input and output coupling circuits comprise two branched high temperature superconducting transmission lines, and include: high temperature superconductor center transmission lines 23*a* for the input and 23*b* for the output, and extended branched center transmission lines 24*a* and 24*b* for the input and output, respectively. Note that 24*a* and 24*b* are configured in an arc shape, which matches the circumferential edges of the resonators 22*a* and 22*b*. The arc shape spreads the electromagnetic fields over a large area for high power handling and also for exciting the azimuthally symmetrical electromagnetic fields more uniformly for the $TM_{010}$ mode. The interconnecting coupling circuit for coupling between resonators is transmission line 25 which in this particular case is configured in a double arc form for the same reasons. The coupling strength of these circuits can be adjusted by varying the length and width of the branched lines, and the gap distance between the resonator and the branched line. The back side of substrate 20 is coated with high temperature superconductor thin film 21 as the ground plane of the filter as shown in the back view in FIGS. 4(*b*) and 4(*c*).

Figure 5A:
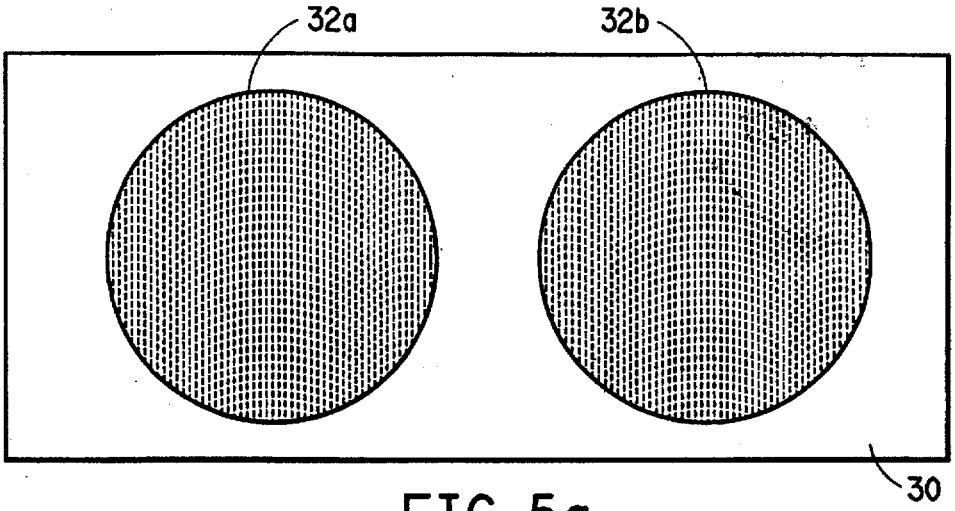
FIG. 5 shows an example of a 2-pole circular shaped $TM_{010}$ mode high temperature superconductor filter of the present invention in the microstrip line form with back-side coupling.
Figure 5B:
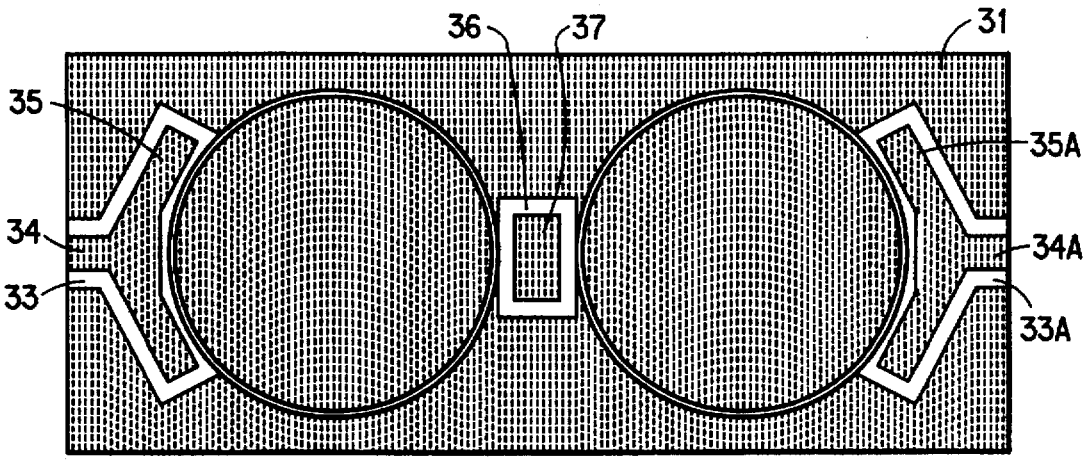
Figure 5C:
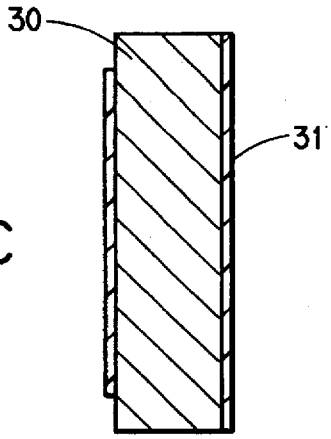

FIG. 5 shows another embodiment of the high power high temperature superconductor filter of the present invention in the microstrip line form. In this particular case, it is a 2-pole filter consisting of 2 circular shaped high temperature superconductor resonators with coupling circuits located on the back side of the substrate, which is the side opposite of the resonators. FIG. 5(*a*) shows the front view, in which two $TM_{010}$ mode high temperature superconductor circular shaped resonators 32*a* and 32*b* are deposited on the front surface of a substrate 30. The back side of the substrate is coated with high temperature superconductor thin film 31 serving as the ground plane for the filter as shown in the cross sectional view given in FIG. 5(*c*). In this particular case, the coupling circuits are located on the back side of the substrate as shown in FIG. 5(*b*). The coupling circuits are in the coplanar line form. The input and output coupling circuits include: the center transmission lines 34 and 34*a*, the branched center transmission lines 35 and 35*a*, and the discontinuities 33 and 33*a* in the thin film of ground plane 31 around the perimeter of the transmission lines. The branched center transmission lines 35 and 35*a* have three sections with different angles to match the circumferential edges of the resonators which have been projected onto the back of the substrate as indicated by the dashed circles in FIG. 5(*b*). The reason for such a configuration is to spread the electromagnetic fields in a large area for increasing the power handling capability, and also for more uniformly exciting the azimuthal symmetrical $TM_{010}$ mode. Preferably the discontinuities 33 and 33*a* are adjacent to or overlap the projection of the resonator shape to provide overlap of the electromagnetic fields of the resonators and the coupling circuits to maximize coupling strength. The interconnecting coupling circuit for coupling between resonators is also in the coplanar line form, and includes the center transmission line 37 and the discontinuity 36 in the film of the ground plane around the perimeter of line 37 as shown in FIG. 5(*b*). The coupling strength can be adjusted by varying the location, shape, and the dimensions of the coupling circuit parts: 33, 33*a*, 34, 34*a*, 35, 35*a*, 36, and 37.

Figure 6A:
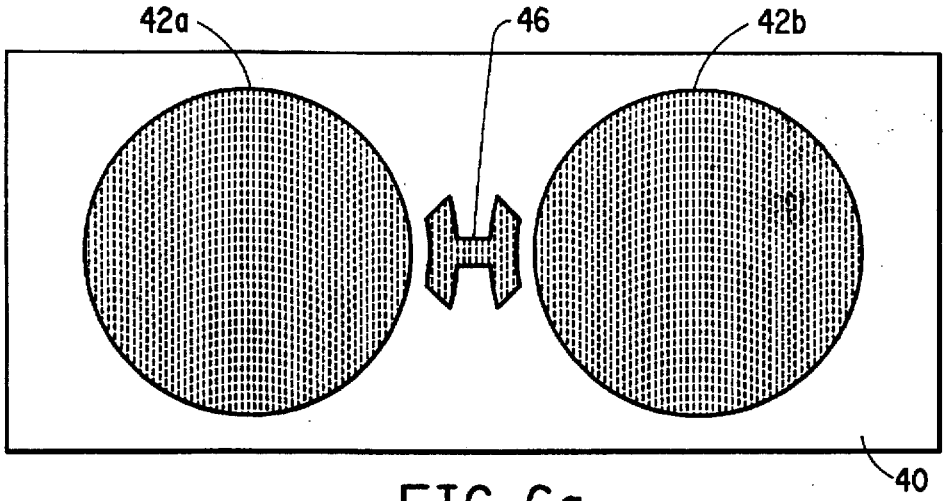
FIG. 6 shows an example of a 2-pole circular shaped $TM_{010}$ mode high temperature superconductor filter of the present invention in the microstrip line form with a combination of the front-side coupling and the back-side coupling.
Figure 6B:
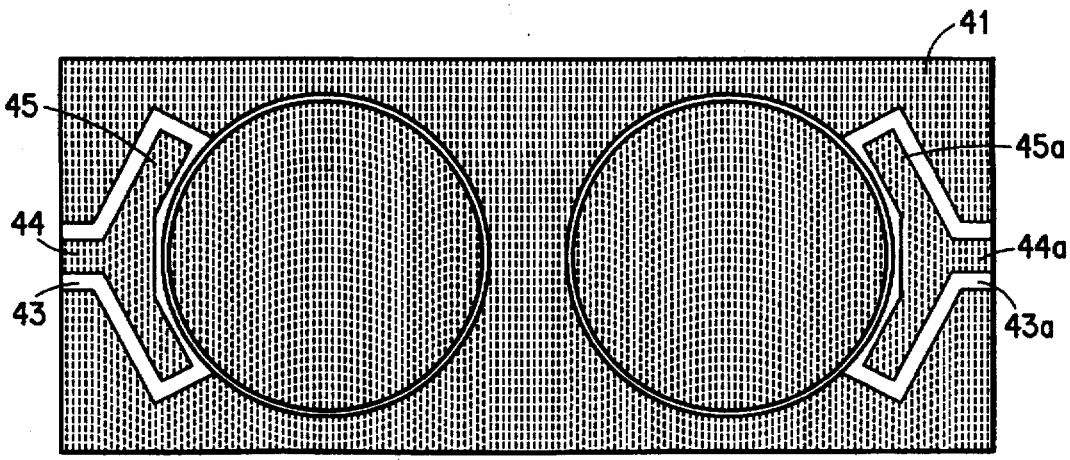
Figure 6C:
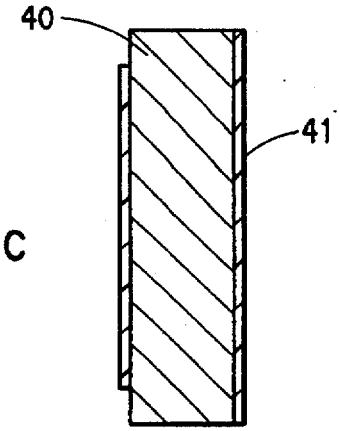

FIG. 6 shows yet another embodiment of the high power high temperature superconductor filter of the present invention in the microstrip line form. In this particular case, it is a 2-pole filter with 2 circular shaped high temperature superconductor resonators on the front side of the substrate and a hybrid coupling circuit. The term "hybrid coupling circuit" is used herein to mean a coupling circuit which is partially located on the front side of the substrate and partially located on the back side of the substrate. FIG. 6(*a*) shows the front view, in which there are two high temperature superconductor circular shaped $TM_{010}$ resonators 42*a* and 42*b*, and a double arc shaped high temperature superconductor interconnecting coupling circuit 46, which couples between the two resonators, deposited on the front surface of the substrate 40. The back side of substrate 40 is coated with high temperature superconductor thin film 41 as shown in FIG. 6(*c*), which serves as the ground plane of the filter. The thin film 41 is also seen in FIG. 6(*b*). The input and output coupling circuits are on the back side of the substrate as shown in FIG. 6(*b*), and include the following parts: the high temperature superconducting center transmission lines 44 and 44*a*, the branched high temperature superconducting center transmission lines 45 and 45*a*, and the discontinuities 43 and 43*a* in the film 41 of the ground plane around the perimeter of the transmission lines. The branched center lines 45 and 45*a* have three sections with different angles to match the projection of the circumferential edges of the resonators, the projection indicated by the dashed circles in FIG. 6(*b*). The reasons for such a configuration are to spread the electromagnetic fields in a large area for increasing the power handling capability, and also for more uniformly exciting the azimuthal symmetrical $TM_{010}$ mode. The coupling strength can be adjusted by varying the location, shape, and the dimensions of the coupling circuit parts: 43, 43*a* , 44, 44*a*, 45, 45*a*, and 46. Preferably the discontinuities 43 and 43*a* are adjacent to or overlap the projections of the resonator edges to maximize coupling.

The high power high temperature superconductor filters of the present invention are not limited to the $TM_{010}$ mode alone. Any $TM_{0i0}$ mode with i=an integer of at least one can be used. For a given resonator, the $TM_{0i0}$ mode with a greater mode index i has a higher resonant frequency than that of the mode with a smaller mode index i. In addition the $TM_{0i0}$ mode (i=1, 2, 3, . . . ) high temperature superconductor filters of the present invention are not restricted to the particular filters having 2 poles as shown in FIG. 4, FIG. 5, and FIG. 6. The filters can have any number of poles according to the desired performance.

Figure 7A:
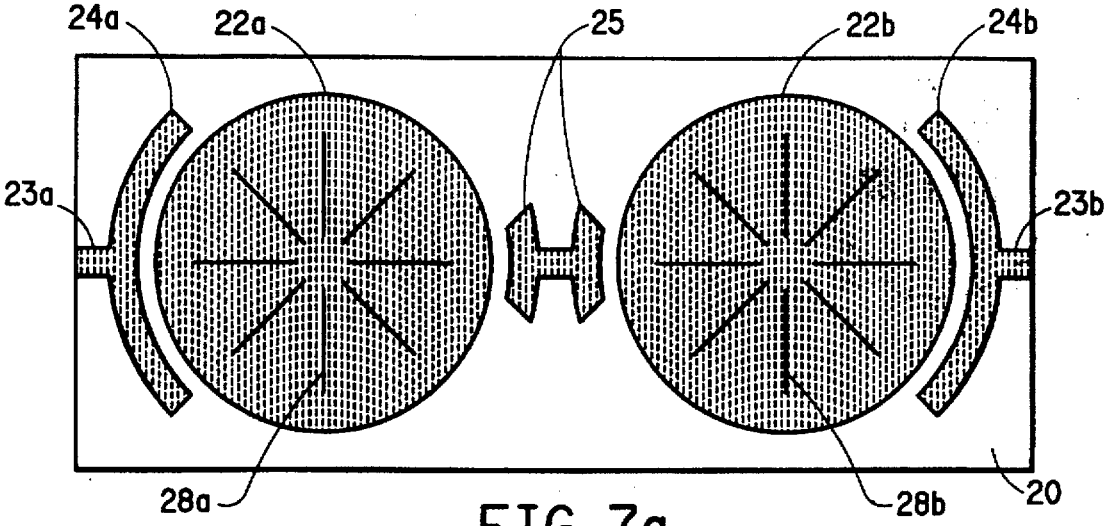
FIG. 7 shows a 2-pole circular shaped $TM_{010}$ mode high temperature superconductor filter of the present invention with front-side coupling similar to that shown in FIG. 4, except radial slots are provided in the high temperature superconductor resonators to suppress interference modes.
Figure 7B:
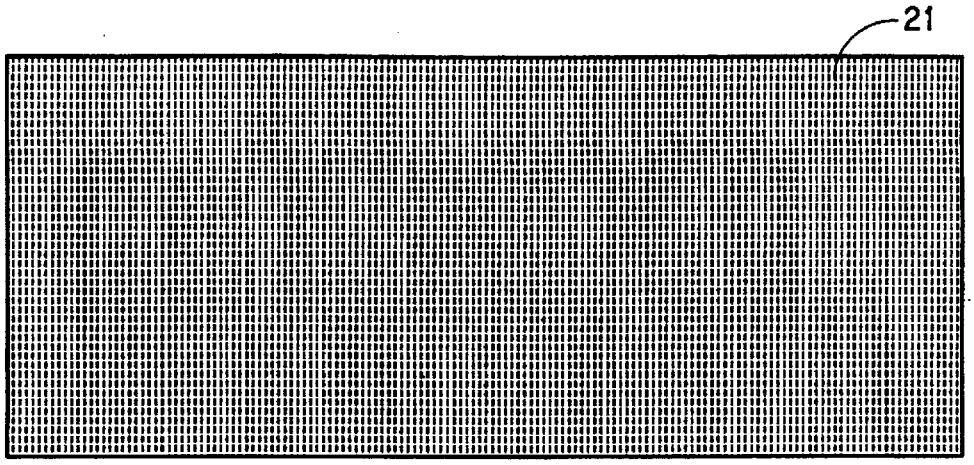
Figure 7C:
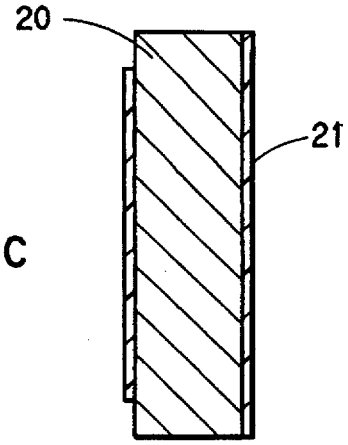

There are other TM and TE modes in a circular shaped resonator having different resonant frequencies, which can act as interference to the operating $TM_{0i0}$ mode (i=1, 2, 3, . . . ) in the filters of the present invention. Measures should be taken to suppress such interfering modes, if their resonant frequencies are near the passing band of the filter operating at $TM_{0i0}$ mode (i=1, 2, 3, . . . ). FIG. 7 shows an example, which is the same filter as shown in FIG. 4 except that there are radial slots in the circular shaped high temperature superconductor resonators for suppressing the unwanted interfering modes. FIG. 7(*a*), FIG. 7(*b*), and FIG. 7(*c*), show the front view, the back view, and the cross sectional view, respectively, of the high power high temperature superconductor filter of the present invention. All of the parts: 20, 21, 22*a*, 22*b*, 23*a*, 23*b*, 24*a*, 24*b*, and 25 are the same as described for FIG. 4, except that as shown in FIG. 7(*a*) there are radial direction slots 28*a* and 28*b* in the high temperature superconductor resonators 22*a*, and 22*b*, respectively. These slots are for suppressing the unwanted interfering non-$TM_{0i0}$ modes (i=1, 2, 3, . . . ). As shown in FIG. 1 and FIG. 2, all the $TM_{0i0}$ modes (i=1, 2, 3, . . . ) have only radial direction current, and such current is not affected by the radial slots since the slots are parallel to the current. But all the other interfering modes with azimuthal direction current are strongly affected by these radial direction slots, which are perpendicular to their azimuthal current causing current redirection and radiation. By carefully selecting the slots' dimensions and location, the unwanted interfering modes can be either suppressed or moved out of the passing band. All the $TM_{0i0}$ modes (i=1, 2, 3, . . . ) high temperature superconductor filters of the present invention can use this means to suppress the adverse effects of interfering modes. Radial slots are positioned parallel to the current of the desired operating mode and perpendicular to the current of any undesired or interfering mode.

Figure 8A:
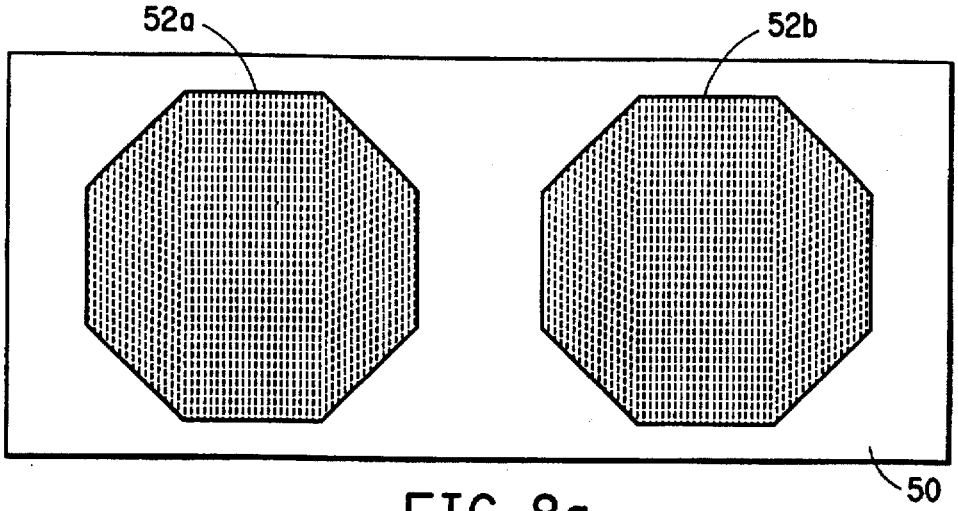
FIG. 8 shows an example of a $TM_{010}$ mode 2-pole high temperature superconductor high power filter of the present invention in the microstrip line form with back-side coupling similar to that shown in FIG. 5, except that the two circular shaped high temperature superconductor resonators are replaced by two octagon shaped high temperature superconductor resonators.
Figure 8B:
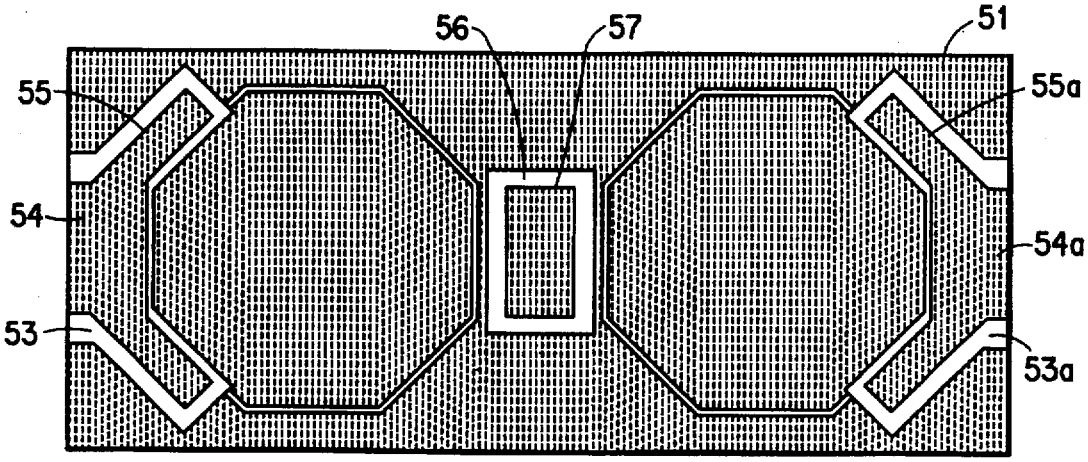
Figure 8C:
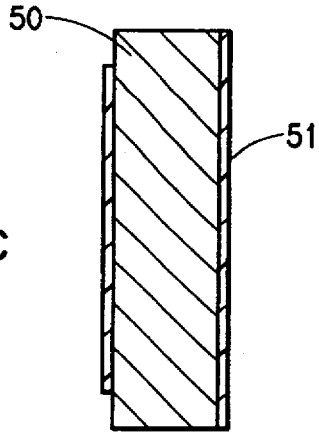

Similar operating modes exist in the symmetrical polygon shaped resonators. As the number of edges increases, the shape of a symmetrical polygon approaches that of a circle. Therefore, it can be expected that the symmetrical polygon resonators having a number of edges or sides n greater than about 6 (n>6) will have the $TM_{0i0}$ modes with attractive features similar to those of the circular shaped resonators. These symmetrical polygon shaped high temperature superconductor resonators can also be used for making the high power high temperature superconductor filters, filter banks, and multiplexers of the present invention. FIG. 8 shows an embodiment of such a symmetrical polygon shaped high temperature superconductor filter. In this particular case, it is a 2-pole symmetrical octagon shaped high temperature superconductor filter having coupling on the back side of the substrate. FIG. 8(*a*), FIG. 8(*b*), and FIG. 8(*c*) show the front view, the back view, and the cross sectional view of the filter, respectively. In FIG. 8(*a*), there are two symmetrical octagon (n=8) high temperature superconductor resonators 52*a* and 52*b* deposited on the front side of the substrate 50. The back side of substrate 50 is coated with a high temperature superconductor thin film 51 serving as the ground plane as shown in FIG. 8(*c*). FIG. 8(*b*) shows the coplanar coupling circuits in this particular case located on the back side of the substrate coated with thin film 51 and include the following parts: the center transmission lines, 54 and 54*a*, branched center transmission lines, 55 and 55*a*, and discontinuities 53 and 53*a* in the film 51 of the ground plane around the perimeter of the transmission lines, for the input and output coupling circuits; and center transmission line 57, and discontinuity 56 in the film of the ground plane around line 57 for the interconnecting coupling circuits for coupling between resonators. Note that the shape of the branched center lines 55 and 55*a* match the shape of the projection of the edges of the symmetrical octagon resonators as shown by the dashed lines. The reasons are to spread the coupling electromagnetic fields in a large area for high power handling capability, and also for more uniformly exciting the $TM_{010}$ operating mode. Preferably the discontinuities 53 and 53*a* are adjacent to or overlap the projection of the resonator shape to maximize coupling.

Any symmetrical polygon pattern having a number of sides or edges greater than six can be used to make the high temperature superconductor resonators of the present invention. The operating mode can be any one of the $TM_{0i0}$ modes (i=1, 2, 3, . . . ). The coupling can be either front-side coupled, back-side coupled, or the combination of front-side and back-side couplings designated hybrid coupling.

The $TM_{0i0}$ mode (i=1, 2, 3, . . . ) high power high temperature superconductor filters of the present invention can be in the microstrip line form (i.e. the signal-ground form) with only one ground plane, or can also be in the strip line form (i.e. the ground-signal-ground form) with two ground planes. FIG. 9 shows a filter of the present invention in strip line form. In this particular case, it is a $TM_{010}$ mode 2-pole high temperature superconductor filter similar to the one shown in FIG. 4 except that this one is in the strip line form with two ground planes. FIG. 9(*c*) shows the cross sectional view, in which there are two substrates 60*a* and 60*b*, and two ground planes 61*a* and 61*b*. The filter's resonators and circuits as shown in FIG. 9(*a*) are sandwiched between these two substrates, 60*a* and 60*b*, with the high temperature superconductor ground planes 61*a* and 61*b* facing outwards. FIG. 9(*b*) shows either of the two high temperature superconductor ground planes 61*a* or 61*b*. As shown in FIG. 9(*a*), the filter consists of two circular shaped high temperature superconductor resonators 62*a* and 62*b*; and the coupling circuits including the following parts: the input and output high temperature superconductor transmission center lines 63*a* and 63*b*; branched center high temperature superconductor transmission lines 64*a* and 64*b*; and the interconnecting coupling line 65 for coupling between the resonators. The arrangement, shape, and the function of these coupling circuits are similar to those in the microstrip line form shown in FIG. 4. These high temperature superconductor circuits shown in FIG. 9(*a*) can be either deposited on one of the substrates such as 60*a* or preferably can be two mirror image circuits deposited on both substrates 60*a* and 60*b*.

The high power $TM_{0i0}$ mode (i=1, 2, 3, . . . ) high temperature superconductor filter of the present invention can be in a "stand alone" form, such as shown in FIG. 4, FIG. 5, FIG. 6, FIG. 7, and FIG. 8, and can also be used as the components for high temperature superconductor filter banks and multiplexers.

The $TM_{0i0}$ mode (i=1, 2, 3, . . . ) high temperature superconductor filter of the present invention handles very high power levels due to the elimination of the wrap-around H-field which causes very sharp current peaks. The basic components of the invented filters are $TM_{0i0}$ mode (i=1, 2, 3, . . . ) high temperature superconductor resonators, which are in the circular shape or in the symmetrical polygon shape with a number of sides greater than six (n>6). The $TM_{0i0}$ mode (i=1, 2, 3, . . . ) high temperature superconductor filter of the present invention comprises any number of such resonators determined by the number of poles of the filter. The coupling circuits for the filters preferably spread the electromagnetic fields over a large area and are evenly distributed along the edges of the resonators or the projection of the edges of the resonators when back side coupling is employed. The coupling circuits can be located on the same substrate surface as the resonators, can be located on the back side of the substrate, opposite the side with the resonators, or can be a combination of both. The $TM_{0i0}$ mode (i=1, 2, 3, . . . ) high temperature superconductor filters can be in the microstrip line form with one high temperature superconductor ground plane deposited on one substrate, or can be in the strip line form with two high temperature superconductor ground planes deposited on two substrates. For suppressing unwanted interfering non-$TM_{0i0}$ modes (i=1, 2, 3, . . . ), the $TM_{0i0}$ mode (i=1, 2, 3, . . . ) high temperature superconductor filters employ radial slots in their high temperature superconductor resonators. The $TM_{0i0}$ mode (i=1, 2, 3, . . . ) high temperature superconductor filters can be used for constructing high power high temperature superconductor filter banks and multiplexers. The filters of the present invention are useful in microwave communication satellites, and in electronic systems for selecting and channeling radiofrequency signals, in particular in telecommunication systems.

What is claimed is:

1. A high temperature superconducting filter operating in the $TM_{0i0}$ mode, where i is an integer of at least one, comprising:

a) at least two resonators, each resonator having azimuthal symmetry and an open circuit at a perimeter of the resonator, each resonator comprising a respective high temperature superconductor film pattern disposed on one side of a substrate, b) a ground plane comprising a high temperature superconducting film disposed on a side of the substrate opposite the at least two resonators, and c) a coupling circuit comprising 1) an input coupling circuit for coupling an input signal to a first one of the at least two resonators, 2) an output coupling circuit for coupling a last one of the at least two resonators to an output signal; and 3) an inter-resonator coupling circuit for coupling one resonator of said at least two resonators to a next adjacent resonator of said at least two resonators;

wherein the filter, when a signal is applied to the filter, generates a magnetic field and wherein said magnetic field is substantially confined between the at least two resonators and the ground plane when operating in a $TM_{0i0}$ mode, where i is an integer of at least 1.

2. The filter of claim 1 wherein the respective high temperature superconducting film patterns comprise patterns selected from the group consisting of circular shaped patterns and symmetrical polygon shaped patterns.

3. The filter of claim 1 wherein each resonator further comprises respective radial slots on a surface of the corresponding high temperature superconducting film pattern and wherein said respective radial slots are respectively positioned parallel to a current of a predetermined operating mode.

4. The filter of claim 1, wherein the filter is in the microstrip line form or the strip line form.

5. The filter of claim 1, further comprising an additional substrate, said additional substrate having an additional coupling circuit disposed on one side thereof and an additional ground plane disposed on an opposite side thereof; said additional substrate being positioned such that the side of the additional substrate having the additional coupling circuit is in contact with the side of the substrate having the at least two resonarors, wherein the filter is in a strip line form and wherein the coupling circuit and the additional coupling circuit are mirror images of one another.

6. The filter of claim 1 wherein the at least portion of the coupling circuit is located on the side of the substrate containing the ground plane.

* * * * *